US005832861A

United States Patent [19]

Taylor

[11] Patent Number: 5,832,861

[45] Date of Patent: Nov. 10, 1998

[54] BOAT DOCKING APPARATUS

[75] Inventor: James Taylor, Springfield, Mo.

[73] Assignee: BHT, Inc., Wichita, Kans.

[21] Appl. No.: 986,921

[22] Filed: Dec. 8, 1997

Related U.S. Application Data

[63] Continuation-in-part of Ser. No. 691,960, Aug. 5, 1996, Pat. No. 5,694,879.

[51] Int. Cl.[6] ..... B63B 21/00

[52] U.S. Cl. ..... 114/230; 267/74

[58] Field of Search ..... 114/221 R, 215, 114/230, 293; 267/69–74; 119/769, 797, 786, 798

[56] References Cited

U.S. PATENT DOCUMENTS 4,681,303 7/1987 Grassano ..... 267/70

4,955,309 9/1990 Ciccone ..... 114/230

*Primary Examiner*—Ed Swinehart

*Attorney, Agent, or Firm*—William Patrick Waters

[57] ABSTRACT

A boat mooring apparatus having an elongated tubular housing wherein the housing is adapted for positioning between a boat and a dock while providing positive control in two directions. Adjacent each end of the housing a pin is utilized to secure an elongated helical spring within the housing. End caps, each including a pair of spaced apart cable guiding apertures, are provided at each end of the housing. At one end of the housing, a cable, looped through the apertures in an end cap, engages the elongated spring within the housing. In a similar manner, another cable is looped through the apertures of the other end cap and engages the other spring within the housing. In use, either cable is suitable for convenient attachment to a boat cleat or to a dock cleat. During operation, the combination of spring, cables and cable guiding end caps cooperate to dampen sudden boat movements and, even under adverse conditions, to transfer loads away from the spring and cables by achieving a slow load transfer, thereby stabilizing the boat and preventing damage to boat and dock.

1 Claim, 2 Drawing Sheets

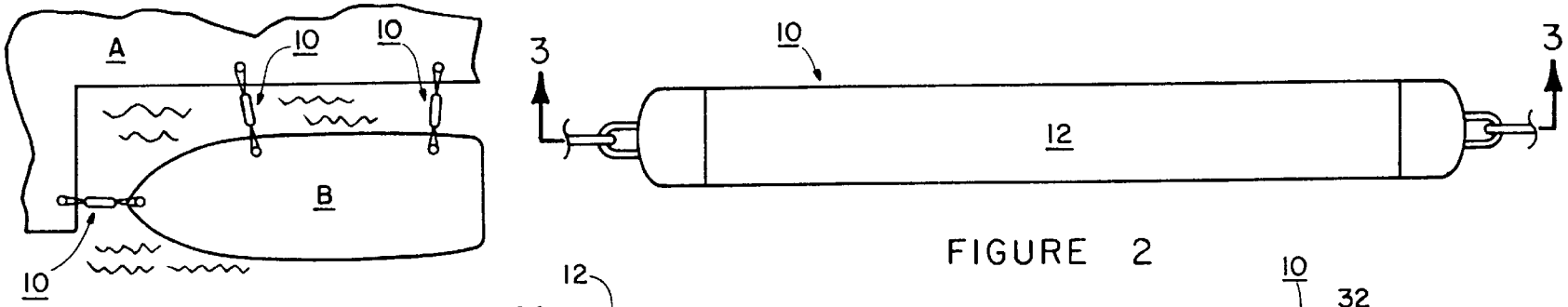
FIGURE 1
FIGURE 2
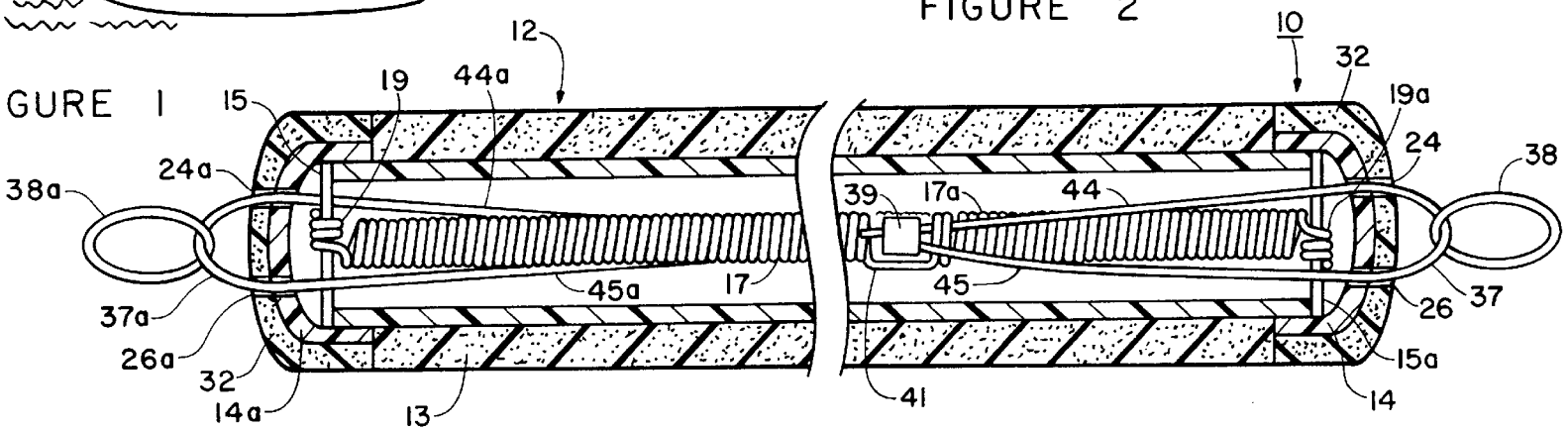
FIGURE 3

BOAT DOCKING APPARATUS

REFERENCE TO PRIOR APPLICATION

This is a continuation-in-part patent application of application Ser. No. 08/691,960 filed Aug. 5, 1996, now U.S. Pat. No. 5,694,879. This patent is incorporated by reference, in its entirety and as though set forth in full herein.

FIELD OF THE INVENTION

The present invention relates in general to docking and mooring systems and, more particularly, to a docking apparatus for boats.

BACKGROUND ART

As set forth in the above referenced patent, various boat docking devices are known and they range in complexity from a simple line to complicated and expensive systems. Conventional docking systems are useful under ordinary conditions when there is little wave action and the wind is not gusting. However, it has been long recognized that it is no easy task to fix a boat to a dock so that both can emerge from a dynamic and sometimes violent encounter with wave and wind without damage. Thus, under conditions of vigorous wave action and gusting winds, conventional devices can fail to protect both the boat and the dock from damage. It is apparent that a need exists for a boat docking apparatus that can protect both boat and dock, even under conditions of adverse wave action or high winds.

The boat docking apparatus disclosed in the above mentioned patent has substantial utility for securing boats under a variety of conditions. It has been found that novel improvements to the apparatus make it more convenient to use in some cases. Those improvements are disclosed herein.

DISCLOSURE OF INVENTION

It is an object of the present invention to provide an improved boat docking apparatus which is capable of holding securely a boat against a dock, without damage to either boat or dock, under conditions of vigorous wind and wave activity.

Briefly, the above object of the present invention is realized by providing a boat mooring apparatus having an elongated tubular housing wherein the housing is adapted for positioning between a boat and a dock while providing positive control in two directions. Adjacent each end of the housing a pin is utilized to secure an elongated helical spring within the housing. End caps, each including a pair of spaced apart cable guiding apertures, are provided at each end of the housing. At one end of the housing, a cable, looped through the apertures in an end cap, engages the elongated spring within the housing. In a similar manner, another cable is looped through the apertures of the other end cap and engages the other spring within the housing. In use, either cable is suitable for convenient attachment to a boat cleat or to a dock cleat. During operation, the combination of spring, cables and cable guiding end caps cooperate to dampen sudden boat movements and, even under adverse conditions, to transfer loads away from the spring and cables by achieving a slow load transfer, thereby stabilizing the boat and preventing damage to boat and dock.

The novel dual spring and cable combination of the present invention affords several advantages since it effectively stabilizes the boat while substantially reducing the distance the boat can move in relation to the dock while, at the same time, providing freedom of movement of the boat under influence of wave or wind.

BRIEF DESCRIPTION OF DRAWINGS

The above mentioned and other objects and features of this invention and the manner of attaining them will become apparent and the invention itself will be best understood by reference to the following description of the embodiment of the invention in conjunction with the accompanying drawings, wherein:

FIG. 1 illustrates one way to use the docking apparatus of the present invention to secure a boat to a dock;

FIG. 2 is an orthographic view of the docking apparatus of the present invention;

FIG. 3 is a sectional view of the docking apparatus taken along the line 3—3 of FIG. 2;

BEST MODE FOR CARRYING OUT THE INVENTION

Figure 4:
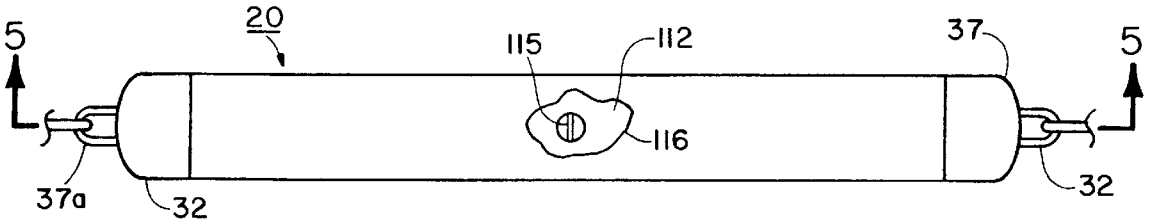
FIG. 4 is an orthographic view of another embodiment of the present invention.

The present invention includes an elongated tubular housing enclosing a pair of springs fixed inside the housing, at opposite ends thereof. A rigid end cap is fixed at each end of the housing. Each spring is attached to a looped cable which, in each case, enters and leaves the housing through an entry aperture, and an exit aperture, respectively, which are disposed in a spaced apart relationship in the end caps. The cables can be fixed to a cleat or stanchion in a novel and convenient manner, as more fully discussed below.

In use, the balanced spring and cable combination cooperate to contain motion away from the dock and to dampen the effects of wave or wind action, thereby preventing damage to boat and dock. In the majority of applications, the cable loops can extend for about 7 inches from the respective end caps, without concern about overextending the spring. This enables the apparatus to be used with the cleats on modern boats.

When a boat, moored with the present invention, is exposed to vigorous wind or wave action, the cables at each end of the housing are pulled out of the housing. As this occurs, in each of the cables, the cable legs are drawn through the two spaced apart apertures in their respective end caps. As the force pulling on the cable increases and the cables and springs are pulled outwardly, the angles formed by the cable legs flatten out as the springs are drawn closer to the spaced apart apertures in their respective end caps so that the changing angle accomplishes a dynamic load transfer from the springs to the housing and end caps. As a result, there is no sudden shock as the cable loops are pulled out to their limit. Instead, a slow transfer takes place thereby dampening any effect from a violent pull on the springs. Once the extreme load is removed, the cable loops are pulled back by their respective springs and normal cushioning resumes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

With reference now to the drawings, there is shown in FIG. 1 one way to use the present invention in which an apparatus 10 is depicted as attaching a boat B to a dock A. While one technique of mooring a boat is shown, it will be readily apparent to one skilled in the art that the apparatus 10, and the other embodiments disclosed herein, can be utilized in other mooring configurations.

Referring now to FIGS. 2 and 3, there is shown a preferred embodiment of the invention in which the apparatus 10 includes an elongated tubular housing 12 having a rigid tube 11, preferably of PVC, which is covered by a protective vinyl nitrile sponge sheath 13. An end cap 14 is fixed to the tube 11 at one end of the housing 12. Preferably, the end cap 14 is of rigid PVC composition. In order to protect the moored boat and the dock from damage, the end cap is covered with a bonded vinyl cap 32 having a thickness of about 0.09 inches.

A rolled steel pin 15 is fixed within the housing 12 at the end opposite the end cap 14. In a preferred embodiment, the pin 15 is of mild steel composition having a length between 1 and 2 inches and, preferably, a length of about 1.6 inches. A diameter of about 0.125 inches is suitable.

An elongated helical spring 17 is disposed coaxially within the housing 12. The spring 17 includes a loop 19 which holds one end of the spring to the pin 15. A cable 37 exits the housing 12 through an opening 24 formed in the end cap 14, loops through a snap ring 38, and enters the housing 12 through an opening 26 formed in the end cap 14. The openings 24 and 26 are spaced between 0.60 inch and 1.25 inch with a preferred spacing of about 0.75 inch. Within the housing 12, the free ends of the cable 37 are joined together by a ferrule 39. The ferrule 39 is nested in an offset portion 41 in the spring 17. With the ferrule 39 so fixed, unwanted rotation of the cable 37 is prevented during operation of the apparatus 10. In a preferred embodiment, the cable 37, and the other cables described herein for the apparatus 10 and for the other embodiments, are "aircraft" type, plastic coated and having a diameter of about ⅛th inch.

While it is recognized that the cable 37 is one continuous length, for purposes of illustration, the cable 37 may be regarded as having a pair of legs 44 and 45 extending away from the spring 17. The leg 44 exits the end cap 14 through the opening 24 while the leg 45 passes through the opening 26 in the end cap 14.

The condition of the spring 17 and the cable 37, as shown in FIG. 3, is that which generally obtains when the apparatus 10 is in use securing a boat to a dock and small loads are placed on the apparatus 10. Under such conditions, the legs 44 and 45 of the cable 37 form an acute angle having the ferrule 39 at the apex of the angle. Under conditions of gentle wave action, or mild gusts of wind, the load on the pin 15 remains relatively constant and, as the spring 17 lengthens and shortens, any shock to boat or dock is dampened. As more particularly set forth in U.S. Pat. No. 5,694,879, as the spring 37 moves toward or away from the end cap 14, the magnitude of the acute angle formed by the legs 44 and 45 changes and, as the cable 37 is pulled from the housing 12, the angle formed by the legs 44 and 45 flattens out as the legs are drawn through the spaced apart openings 24 and 26. As a result, dynamic load transfer between the spring and cable combination and the tube 11 takes place.

The dynamic load transferring characteristics of the apparatus 10 are enhanced by the duplication of the above described elements, within the housing 12. Thus, at an end of the housing 12 opposite its identical counterpart, there is am end cap 14*a,* having spaced apart openings 24*a* and 26*a* through which, respectively, pass legs 44*a* and 45*a* of a cable 37*a.* The cable legs are fixed to an elongated spring 17*a* which, in turn, is fixed to a pin 15*a.* The duplication of these elements renders the apparatus 10 more convenient to use, in some cases, and enhances load dampening characteristics.

Figure 5:
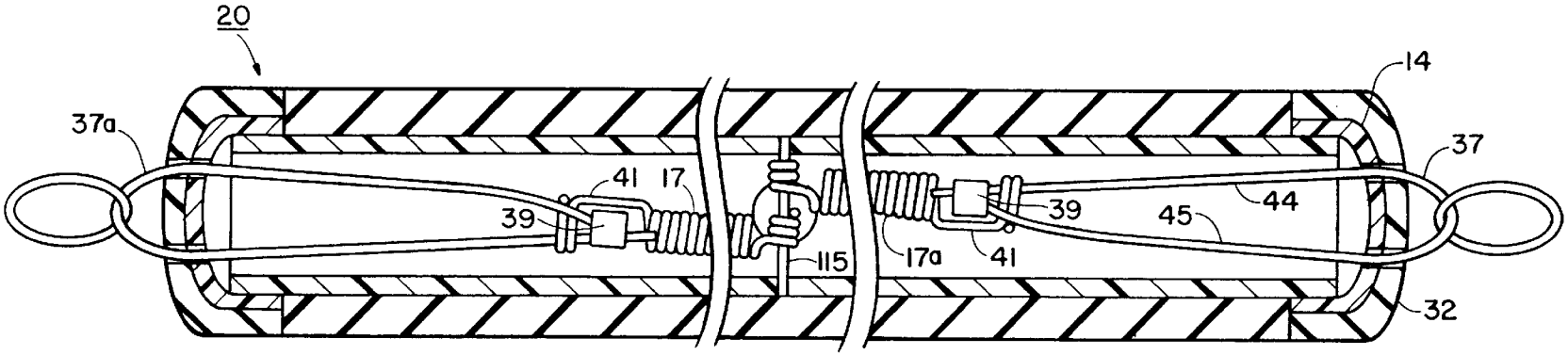
FIG. 5 is a sectional view of the embodiment of FIG. 4 taken along the line 5—5.

Referring now to FIGS. 4 and 5, there is shown an embodiment 20 of the present invention. The apparatus 20 includes all of the elements of the apparatus 10 except that the pins 15 and 15*a* are replaced with a single, centrally mounted pin 115 to which both springs 17 and 17*a* are fixed. As shown in FIG. 4, a opening 116 in a housing 112 is provided for facilitating assembly of the apparatus 20.

With reference now to FIG. 5, there is shown yet another embodiment 30 of the present invention. The apparatus 30 is especially useful in the case of large, heavy vessels where it is desirable to have several cable loops engage the boat cleat to dampen the effects of vigorous wind and wave action. The apparatus 30 includes a tubular PVC housing 212, covered by a vinyl nitrite sponge sheath 213. The housing 212 has a pair of PVC end caps 214 and 216 fixed thereto. The end cap 216 has a pair of spaced apart (about one inch) openings 220 and 221. A cable 225 enters the housing 212 through the opening 220, loops about a pin 215 (similar to the pin 15) which is located adjacent the end cap 216 and exits the end cap 216 through the opening 221. The cable 225 is used to secure the apparatus 30 to a dock in the manner described in U.S. Pat. No. 5,694,879.

Three elongated springs, 231, 232 and 233, respectively, are fixed to the pin 215. These springs are similar in structure and function to the spring 17, each being attached to cables 239, 241 and 242 respectively. Each of the cables 239, 241 and 242 has leg portions fixed within the housing, in a manner similar to that described above for the apparatus 10 by a ferrule 39, each of which is held in an offset 41 of the respective springs 231, 232 and 233.

Figure 6:
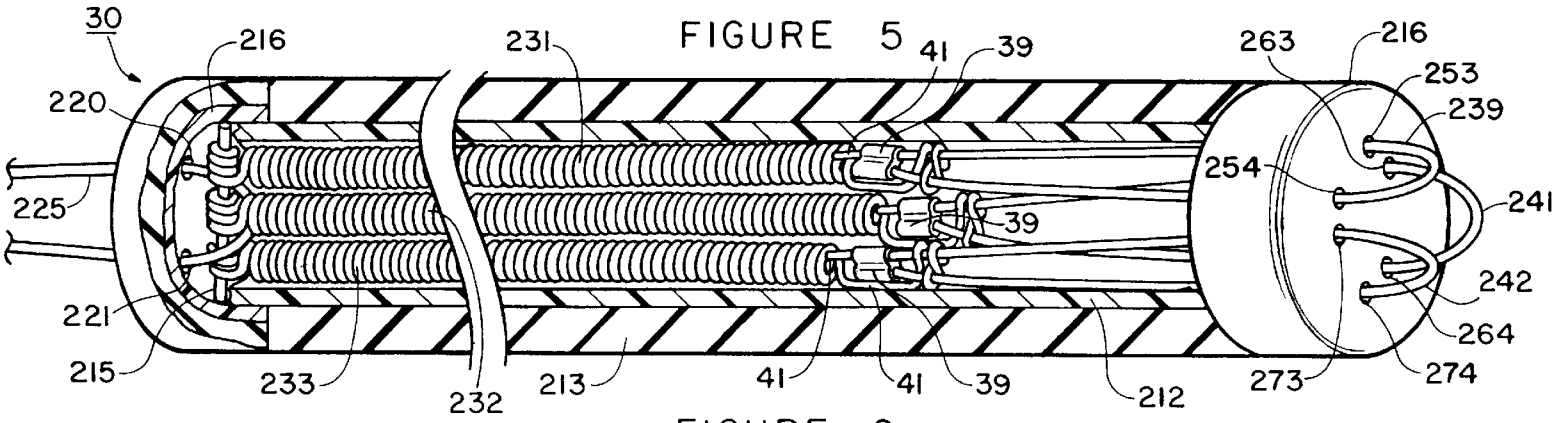
FIG. 6 is an isometric, partially cut away, view of yet another embodiment of the present invention..

The end cap 216 has a first pair of spaced apart openings 253 and 254, a second pair 263 and 264, and a third pair 273 and 274. These openings are similar in function and dimensions to the openings 24 and 26 of the apparatus 10. As will be noted by reference to FIG. 6, the openings 253 and 254 accommodate the cable 239, the openings 263 and 264 accommodate the cable 241 while the openings 273 and 274 accommodate the cable 242.

During use of the apparatus 30 in docking larger and heavier vessels, the apparatus may first be attached to a dock, utilizing the cable 225, and then one, two or all three of the cables 239, 241 and 242 can be fixed to a boat mounted cleat. In this manner, a convenient and effective technique for docking larger vessels is provided.

It will be evident that there are additional embodiments and applications which are not disclosed in the detailed description but which clearly fall within the scope and spirit of the present invention. The specification is, therefore, intended not to be limiting, and the scope of the invention is to be limited only by the following claims.

What is claimed is:

1. An apparatus for securing a boat to a dock, said dock having attachment means, the apparatus comprising:

an elongated housing, said housing being adapted for positioning between a boat to be (locked and the dock attachment means, said housing having spring fixing means disposed therewithin;

a plurality of elongated helical springs disposed within said housing, said springs being fixed to said fixing means within said housing;

first cable means fixed to a first one of said plurality of elongated springs, said first cable means being adapted for releasable engagement of said dock attachment means; and second cable means, said second cable means being fixed to a second one of said plurality of elongated springs, said second cable means having means for releasable attachment to a boat.

* * * * *